US005893525A

United States Patent [19]

Gingras

[11] Patent Number: 5,893,525

[45] Date of Patent: Apr. 13, 1999

[54] REFINER PLATE WITH VARIABLE PITCH

[75] Inventor: Luc Gingras, Leeds, United Kingdom

[73] Assignee: Durametal Corporation, Tualatin, Oreg.

[21] Appl. No.: 08/886,310

[22] Filed: Jul. 1, 1997

[51] Int. Cl.[6] ..... B02C 7/12

[52] U.S. Cl. ..... 241/298; 241/261.3

[58] Field of Search ..... 241/261.2, 261.3, 241/298, 297, 296

[56] References Cited

U.S. PATENT DOCUMENTS

| | | | |
|---|---|---|---|
| 1,131,272 | 3/1915 | Reynolds . | |
| 1,144,089 | 6/1915 | Alsted . | |
| 1,368,609 | 2/1921 | Czarev . | |
| 1,477,013 | 3/1923 | Snyder . | |
| 3,040,997 | 6/1962 | Borden . | |
| 3,240,437 | 3/1966 | Horstman . | |
| 3,674,217 | 7/1972 | Reinhall . | |
| 3,910,511 | 10/1975 | Leider et al. . | |
| 3,974,971 | 8/1976 | Reinhall . | |
| 4,676,440 | 6/1987 | Perkola . | |
| 4,712,745 | 12/1987 | Leith . | |
| 4,953,796 | 9/1990 | Virving . | |
| 5,181,664 | 1/1993 | Kohler . | |
| 5,373,995 | 12/1994 | Johannson . | |
| 5,476,228 | 12/1995 | Underberg | 241/261.2 |

FOREIGN PATENT DOCUMENTS

3432255 A1 3/1986 Germany .

*Primary Examiner*—Mark Rosenbaum
*Attorney, Agent, or Firm*—Alix, Yale & Ristas, LLP

[57] ABSTRACT

A refiner plate for the face of a refiner disc comprising a plurality of refiner segments arranged side-by-side on the face of the disc to form a substantially annular refining region. Each refiner segment has an inner refining zone for receiving the material to be refined and an outer refining zone. The outer refining zone has a plurality of radially disposed bars defining an top surface and a plurality of radially disposed channels disposed intermediate the bars defining a lower base surface. At least one of the top surfaces has at least one radially extending groove defining a pair of blades and an intermediate base surface at the bottom of the groove. The intermediate base surface is positioned at a height intermediate the top surface and the lower base surface. The width of the grooves are narrower than the width of the channels.

18 Claims, 2 Drawing Sheets

REFINER PLATE WITH VARIABLE PITCH

BACKGROUND OF THE INVENTION

The present invention relates generally to disc grinders for lignocellulosic material. More particularly, the present invention relates to refiner plate segments for such an apparatus.

In high consistency mechanical pulp refiners, the wood fibers are worked between two relatively rotating discs on which refiner plates are mounted. The plates usually have radial bars and grooves. A large volume of steam is produced between the plates as a result of this refining work. For effective refining, the fibers must be retained between the plates on the bar surfaces despite the high velocity of the flowing steam, and the enormous centrifugal forces. Typically, dams are provided in the grooves to interrupt material flow and thus improve the retention time of the material in the refining region.

In a typical refiner plate with radial bars and grooves, the bars provide impacts or pressure pulses which separate and fibrillate the fibers. The grooves enable feeding of the fibers and steam extraction. Near the perimeter of the plates, high radial steam flow and high centrifugal force both act to sweep the fibers outwardly from between the plates prematurely, thus reducing the refining effectiveness. The flow restrictions due to a small gap between the opposing plates and fiber-filled grooves result in a steam pressure peak between the plates, located radially inward from the perimeter. The force of this pressure peak on the discs is a major source of the refining thrust load, and can induce control instability at high motor loads.

It is thus desirable that the steam generated during refining be discharged from the refining region as quickly as possible, while the pulp is retained within the region as long as possible. The evacuation of steam is especially difficult for refiner plates which have a fine pattern of relatively narrow bars and grooves in the refining zone. Such plates produce heat from more fiber impacts per revolution than coarser refiner plates, and the grooves on fine refining zones are narrower, reducing the cross-sectional area available for the flow of steam. Consequently, the grooves in fine refining zones are prone to plugging due to the accumulation of the material being refined. Conventional refiner plates have a groove width greater than a certain minimum, to reduce the amount of plugging. Such a minimum groove width effectively limits the fineness of the refiner plate. In addition, the bars of fine refining zones are very narrow and have a height that is high in relationship to the width of the bar. Consequently, such bars are prone to breakage.

SUMMARY OF THE INVENTION

Briefly stated, the invention in a preferred form is a refiner segment which has at least one refining zone including a plurality of substantially radially extending bars and a plurality of radially extending channels disposed intermediate the bars. Each of the bars has a top surface and each of the channels has a lower base surface at the bottom of the channel. At least one of the top surfaces has at least one radially extending groove that defines an intermediate base surface at its bottom and forms two adjacent blades. The intermediate base surface is positioned intermediate the top surface and the lower base surface such that the height of the blades is less than the total height of the bars relative to the channel bottom and the width of the grooves are not equal to the width of the channels. This forms radially extending recesses of differing pitch.

The use of grooves to create blades defining additional grinding edges, increases the grinding efficacy of the refiner disc. The grooves are narrower and shallower than the channels. Therefore, the blades defined by the grooves are resistant to the shear force imposed on them during refining operations and are less prone to breakage than conventional narrow bars. Steam flow preferentially occurs in the wider, deeper channels. Consequently plugging of the grooves has no appreciable effect on steam evacuation.

It is an object of the present invention to provide a refiner plate for the face of a refiner disc, which facilitates the removal of steam while retaining the pulp in the refiner region to achieve satisfactory pulp quality.

Other objects and advantages of the invention will become apparent from the drawings and specification.

BRIEF DESCRIPTION OF THE DRAWINGS

The present invention and its numerous objects and advantages will become more apparent to practitioners in this field from the following detailed description and reference to the accompanying drawings, in which.

DETAILED DESCRIPTION OF THE PREFERRED EMBODIMENT

Figure 1:
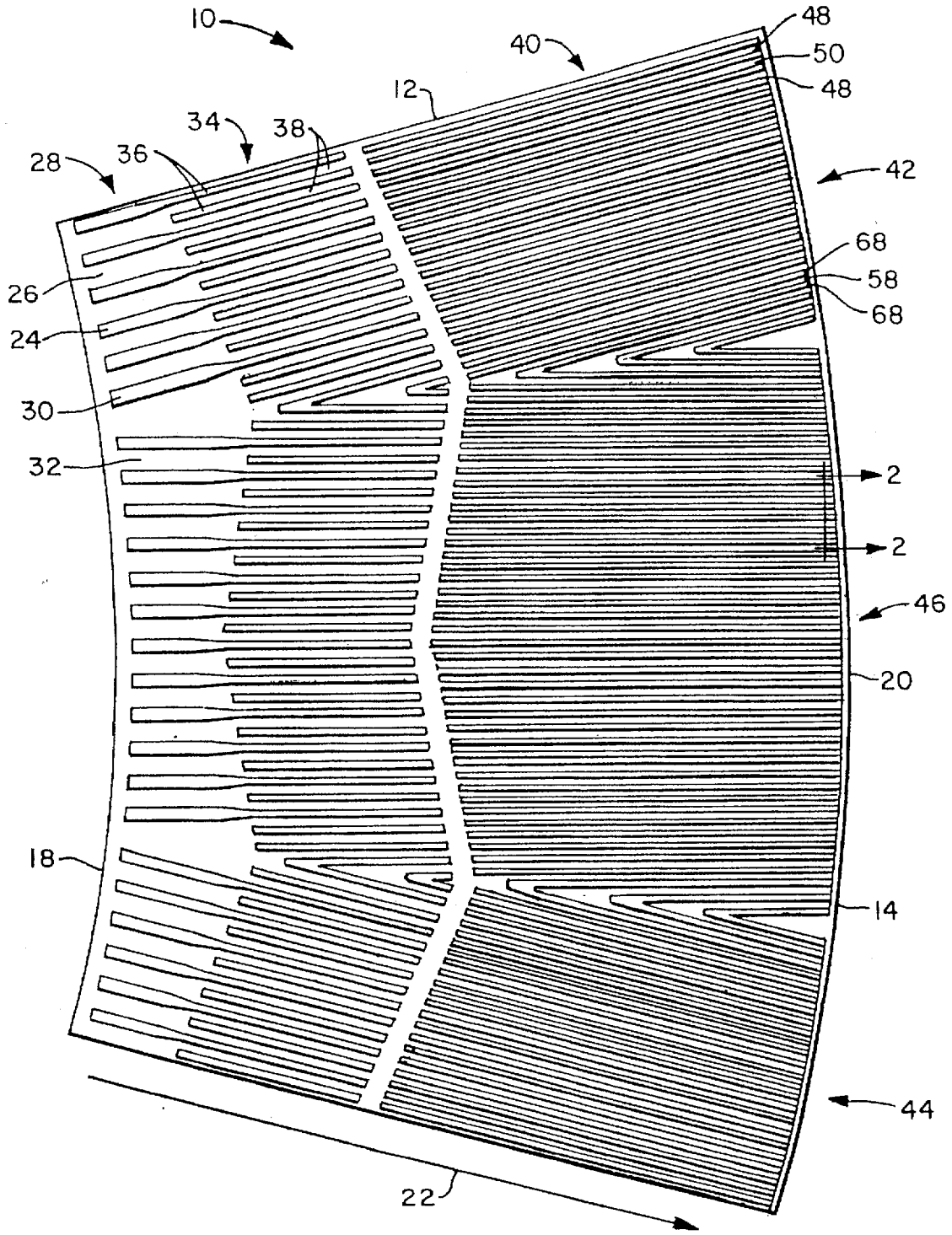
FIG. 1 is an elevation view of a refiner plate segment in accordance with the invention.

With reference to the drawings wherein like numerals represent like parts throughout the several figures, a portion of a substantially circular refiner plate in accordance with the present invention is generally designated by the numeral 10. With reference to FIG. 1, the portion 10 comprises a refiner plate segment 12 which is securable to the front face of a substantially circular refiner disc 14. Although in the illustrated embodiment the portion has a unitary segment, each portion could alternatively be provided as two or more segments.

The plate segment 12 is attached to the disc face, in any convenient or conventional manner, such as by bolts (not shown) passing through bores. Typically, one end of the bolt engages the disc 114 and at the other end has head structure bearing against a countersunk surface in the plate 12. The disc 14, only a portion of which is shown, has a center about which the disc rotates, and a substantially circular periphery. The refiner plate segments 12 are arranged side-by-side on the face of the disc 14, to form a substantially annular refiner face, shown generally at 16. The face 16 forms a portion of a refiner region, when confronting another refiner plate (not shown) carried by another disc. The opposing disc may be either a rotating disc (rotor) or a non-rotating disc (stator).

Each refiner plate segment 12 has an inner edge 18 near the center of the disc 14, and an outer edge 20 near the periphery of the disc 14. The remainder of this description will refer to a single refiner segment 12, but it should be understood that all the segments 12 which define the annular plate, are preferably substantially similar. The plate segment 12 has, on its face 16, at least two radially distinct patterns of bars 24 and channels 26 between the bars 24 (FIGS. 1 and 2), whereby material to be refined can flow in the channels 26 in the general direction from the inner edge 18 to the outer edge 20 of the plate segment 12. Each bar 24 and channel 26 extends substantially radially, i.e., in the direction indicated by the arrow 22 representing a radius of the disc 14 or obliquely to but in the general direction of arrow 22.

With reference to FIG. 1, a first or inlet zone 28 has a multiplicity of bars 30 and channels 32 between adjacent bars 30 which are especially adapted for receiving wood chips, previously refined fiber, or the like and performing an initial refining operation thereon to reduce the size of the material and funnel it radially outward into a second, primary refining zone 34. The primary refining zone 34 has a multiplicity of bars 36 and channels 38 between adjacent bars 36, which are adapted to receive the partially refined material, to further reduce the size of the material and funnel it radially outward into a third fine refining zone 40. A fine refining zone 40 may be provided between the primary refining zone 34 and the outer edge 20 of the plate to further fibrillate the material. The inlet, primary refining and fine refining zones 28, 34, 40 each comprise one or more fields within which the pattern of bars and grooves is relatively uniform. For example, the fine refiner zone 40 contains three fields 42, 44 and 46. The bars 24 and channels 26 within each field 42, 44, 46 extend in parallel, substantially in the radial direction 22. Alternately, the bars and channels may define a radial array where the channel width increases from the inside diameter to the outside diameter and the width of the bars remains relatively constant.

Since the disc and plate rotate, the partially refined material is directed, as a result of centrifugal force, radially outward. In order to ensure that the partially refined material in the primary and fine refining zones 34, 40 is further refined, each channel 26, particularly in zone 40, may have one or more dams (not shown). Such dams may comprise surface dams, which means that the dams extend upwardly so that the top surface is at the same elevation as the top surface of the adjacent bars 24, or subsurface dams, which means that the dams extend upwardly so that the top surface is below the elevation of the top surface of the adjacent bars 24. The dams cause material within the channel to be lifted to the top surface 54 of the bars 48 where it may be further refined.

Figure 2:
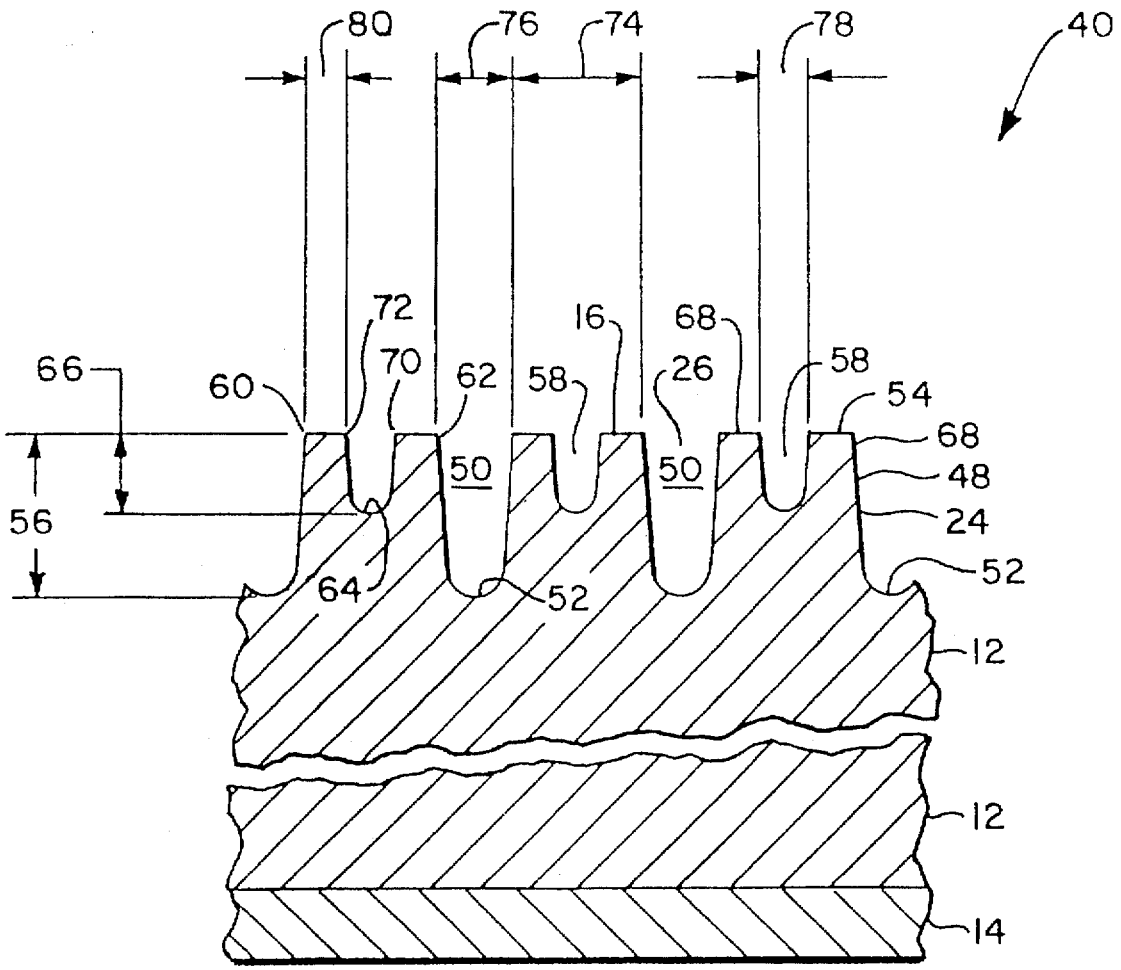
FIG. 2 is a section view along line 2—2 of FIG. 1.

With reference to FIG. 2, each field of the fine refining zone 40 also has a multiplicity of bars 48 and channels 50 between adjacent bars 48. Each of the channels 50 has a lower base surface 52 and each of the bars 48 has an upper top surface 54, wherein the top surface 54 of the bar 48 and the lower base surface 52 of the channel 50 defines the height 56 of the bar 48. In one embodiment of a field according to the present invention, at least one substantially radially extending groove 58 is formed in the top surface 54 of each bar 48 intermediate the substantially radially extending first and second edges 60, 62 of the bar 48. Each of the grooves 58 defines an intermediate base surface 64 which is positioned at a height intermediate the top surface 54 of the bar 48 and the lower base surface 52 of the channel 50, wherein the top surface 54 of the bar 48 and the intermediate base surface 64 of the groove 58 generally defines the height 66 of two adjacent blades 68. Each groove 58 further creates an additional two substantially radially extending edges 70, 72. These edges 70, 72 define grinding surfaces and cause additional pulsations during refining operations, increasing the grinding efficacy of the refiner disc.

Preferably, the width 74 of the bars 48 is 3.6 mm to 7.2 mm, the width 76 of the channels 50 is 2.0 mm to 3.6 mm, the width 78 of the grooves 58 is 1.2 mm to 2.4 mm, the height 56 of the bars 48 is 4.0 mm to 8.0 mm, and the height 66 of the blades 68 is 2.0 mm to 5.0 mm. The width 76 and depth 56 of the channels 50 should be greater than the width 78 and depth 66 of the grooves 58 to ensure that steam flow preferentially occurs in the channels 50.

The combination of wide, deep channels 50 and shallow, narrow grooves 58 provides several benefits. The channels 50 of the subject refiner plate 10 are wider and deeper than the grooves/channels of conventional refiners, providing a greater cross-sectional area for the flow of steam. Due to the relatively large flow areas of the channels 50 in comparison to the grooves 58 of the subject refiner plate 10, the steam flow preferentially occurs in the channels 50. Since the grooves 58 do not account for a significant portion of the steam flow, the plugging of individual grooves 58 will not have an appreciable impact on the steam evacuation.

The combination of deep channels 50 and shallow grooves 58 produces bars 48 having a width 74 that is greater than the width of such bars in conventional refiners. Although the grooves 58 produce blades 68 having a relatively narrow width 80, the width 80 of such blades 68 is large relative to their height 66 in comparison to bars in conventional refiners. Consequently, the blades 68 and bars 48 are much more resistant to the shear forces imposed during refining operations and therefore are less prone to breakage.

The width 78 of the grooves 58 be may reduced to allow forming a larger number of grooves 58, and corresponding blades 68. The minimum width 76, 78 of the channels 50 and grooves 58 is determined by the material that is to be refined. If a channel 50 or groove 58 is too narrow, typically less than half the fiber length, the fiber does not see the edge 60, 62, 70, 72 created by the channel 50 or groove 58 and the edge 60, 62, 70, 72 will not contribute to the refining process.

In alternative embodiments, grooves 58 may not be formed in the top surface 54 of some of the bars 48 and the number of grooves 58 that are formed in adjacent bars 48 may not be the same. Further, the height 56, 66 of the bars 48 and/or blades 68 and the widths of the grooves 58 and blades 68 may be varied in any given refiner disc or refiner segment 12. It should be appreciated that the pattern formed by the bars 48, channels 50 and grooves 58 of the fine refining zone 40 may be selected to optimize the refining of a particular species of wood or to the particular operating conditions.

While preferred embodiments have been shown and described, various modifications and substitutions may be made thereto without departing from the spirit and scope of the invention. Accordingly, it is to be understood that the present invention has been described by way of illustration and not limitation.

What is claimed is:

1. A rotating disc refiner segment for refining a lignocellulosic material with production of steam which is transported substantially radially along the segment, the segment comprising:

a plurality of substantially radially extending bars and a plurality of substantially radially extending channels disposed intermediate said bars to form a pattern of bars and channels, each said channel having a channel width and a lower base surface at the bottom of said channel, each of said bars having a top surface and substantially radially extending first and second edges, the top surface of at least one of said bars having at least one radially extending groove formed therethrough intermediate said first and second edges, each of said grooves having a groove width and an intermediate base surface disposed at a height intermediate said top surfaces and said lower base surfaces, said groove width being less than said channel width at a corresponding relative height of said channel;

whereby significantly more steam is transported substantially radially outwardly through the channels than through the grooves.

2. The refiner segment of claim 1 wherein said groove width is substantially 15% to 60% narrower than said channel width.

3. The refiner segment of claim 1 wherein each of said top surfaces has at least one substantially radially extending groove.

4. The refiner segment of claim 1 wherein less than all of said top surfaces have at least one radially extending groove.

5. The refiner segment of claim 4 wherein a plurality of said top surfaces have at least one radially extending groove.

6. The refiner segment of claim 4 wherein a plurality of said top surfaces have at least one radially extending groove and a plurality of said top surfaces have no radially extending groove.

7. The refiner segment of claim 1 wherein each of said grooves divides the respective bar into two adjacent blades.

8. The refiner segment of claim 7 wherein said intermediate bass surface for a particular groove and said top surface of that particular bar, define a height for said adjacent blades.

9. The refiner segment of claim 1 wherein at least one of the bars has a plurality of the grooves, wherein the width of at least one of the grooves in the bar is not equal to the width of the other of the grooves in the bar.

10. The refiner segment of claim 1 wherein at least one of the bars has a plurality of the grooves, wherein the grooves in the bar divide the bar into a plurality of blades, each of the blades having a width wherein the width of at least one of the blades in the bar is not equal to the width of the other of the blades in the bar.

11. A refiner having relatively rotating opposed discs which carry plates formed by a plurality of segments for refining lignocellulosic material wherein each segment comprises a pattern including a plurality of substantially radially extending bars and a plurality of substantially radially extending channels disposed intermediate said bars each of said channels having a width and defining a lower base surface at the bottom of each said channel, each of said bars having a top surface, at least one of said top surfaces having at least one substantially radially extending groove formed therein, each said groove having a width and defining adjacent blades on one of said bars and an intermediate base surface at the bottom of said groove disposed at a height intermediate said top surface and said lower base surface, wherein said intermediate base surface and said top surface define a height for said blade relative to said intermediate base surface and said lower base surface and said top surface define a height for said bar relative to said lower base surface, wherein said height of said bar is greater than said height of said blade and wherein said width of said channel is greater than said width of said groove at a corresponding relative height of said groove, whereby significantly more steam is transported substantially radially outwardly through the channels than through the grooves.

12. The refiner of claim 11 wherein at least one of said top surfaces has no radially extending groove.

13. The refiner of claim 11 wherein a plurality of said top surfaces have at least one radially extending groove and a plurality of said top surfaces have no radially extending groove.

14. The refiner of claim 11 wherein at least one of said top surfaces has a plurality of said grooves defining a plurality of said blades.

15. The refiner of claim 14 wherein the width of one of said plurality of grooves is not equal to the width of at least one of the other of said plurality of grooves.

16. The refiner of claim 14 wherein each of the blades has a width, wherein the width of at least one of said plurality of blades is not equal to the width of at least one of the other of said plurality of blades.

17. The refiner of claim 11 wherein each of said channels and each of said bars has oppositely disposed inboard and outboard ends, said inboard and outboard ends each having a width wherein said width of said outboard end of each of said channels is greater than said width of said inboard end of said channel and said width of each of said channels generally tapers from said outboard end to said inboard end, and wherein said width of said outboard end of each of said bars is substantially equal to said width of said inboard end of said bar.

18. The refiner of claim 11 wherein each of said channels and each of said bars has oppositely disposed inboard and outboard ends, said inboard and outboard ends each having a width wherein said width of said outboard end of each of said channels is substantially equal to said width of said inboard end of said channel and wherein said width of said outboard end of each of said bars is substantially equal to said width of said inboard end of said bar.

* * * * *